United States Patent [19]

Witschi

[11] 4,269,232

[45] May 26, 1981

[54] PROTECTIVE CAP FOR PIPES

[75] Inventor: Fritz Witschi, Biel, Switzerland

[73] Assignee: Von Roll AG, Switzerland

[21] Appl. No.: 18,426

[22] Filed: Mar. 7, 1979

[30] Foreign Application Priority Data

Apr. 10, 1978 [CH] Switzerland ..... 3837/78

[51] Int. Cl.[3] ..... B65D 59/06; F16L 55/10

[52] U.S. Cl. ..... 138/96 R; 138/89; 220/271

[58] Field of Search ..... 138/89, 96 R, 96 T; 220/271

[56] References Cited

U.S. PATENT DOCUMENTS

| | | | |
|---|---|---|---|
| 183,953 | 10/1876 | McNabb | 138/96 R |
| 1,837,345 | 12/1931 | Thomas | 138/96 R |
| 1,906,182 | 4/1933 | Riney | 138/96 T |
| 2,737,205 | 3/1956 | Stringfield | 138/96 R X |
| 4,020,874 | 5/1977 | Palarino | 138/96 T |
| 4,079,756 | 3/1978 | Smiley | 138/96 T |
| 4,119,121 | 10/1978 | Smiley | 138/96 T |
| 4,139,005 | 2/1979 | Dickey | 138/96 R X |

*Primary Examiner*—James E. Bryant, III

*Attorney, Agent, or Firm*—Roylance, Abrams, Berdo & Farley

[57] ABSTRACT

The cap is an ethylene-propylene elastomer cup which is forced over the ends of a pipe section to protect the pipe end from damage and to protect the inside of the pipe from contamination by foreign material. A retaining bead on the outside of the cap lip prevents tearing and holds the cap firmly on the pipe end. The cap wall is about twice as thick as the floor. The outer perimeter portion of the floor is of increased thickness. One or two ring-shaped depressions centered in the floor permit the floor to be expanded radially when the cap is installed, so that a single cap size can be used for various pipe diameters. A ventilating port is provided in the floor.

5 Claims, 3 Drawing Figures

PROTECTIVE CAP FOR PIPES

BACKGROUND OF THE INVENTION

This invention relates to a cap for protecting the ends and the inside space of pipe sections, especially those for drinking water lines. The cap has a floor portion and a wall portion.

The general term "pipe section" as used herein means pipes, castings, fittings, and other elements which come into contact with the transported medium.

For pipe sections for particular purposes, i.e. for drinking water lines, it is desirable to prevent a contamination of the inside. Such contamination can result especially in transport, shifting, and storage, as well as during the time between delivery and installation at the construction site. The contamination can be dust, lead residues from exhaust gas, or the like. Improvised or temporary measures do not provide sufficient protection. They could be accidentally removed, for instance by vibration or by impact against other objects during transport. In addition, such means do not offer an effective protection against transport damage which should be prevented especially at the ends of the pipe sections.

It is an object of the present invention to provide a protective member of the type described above which reliably prevents the entry of foreign substances into the inside of the pipe section and simultaneously protects the end portions, especially those serving for pipe connections, against transport damage.

SUMMARY OF THE INVENTION

In accordance with the present invention, there is provided a novel protective cap which is generally cup-shaped with a wall portion and a floor portion. The floor portion has at least one expansion section which serves to minimize the tension in the floor of the installed insert which could lead to its being forced off the pipe end.

DESCRIPTION OF THE PREFERRED EMBODIMENTS

Figure 1:
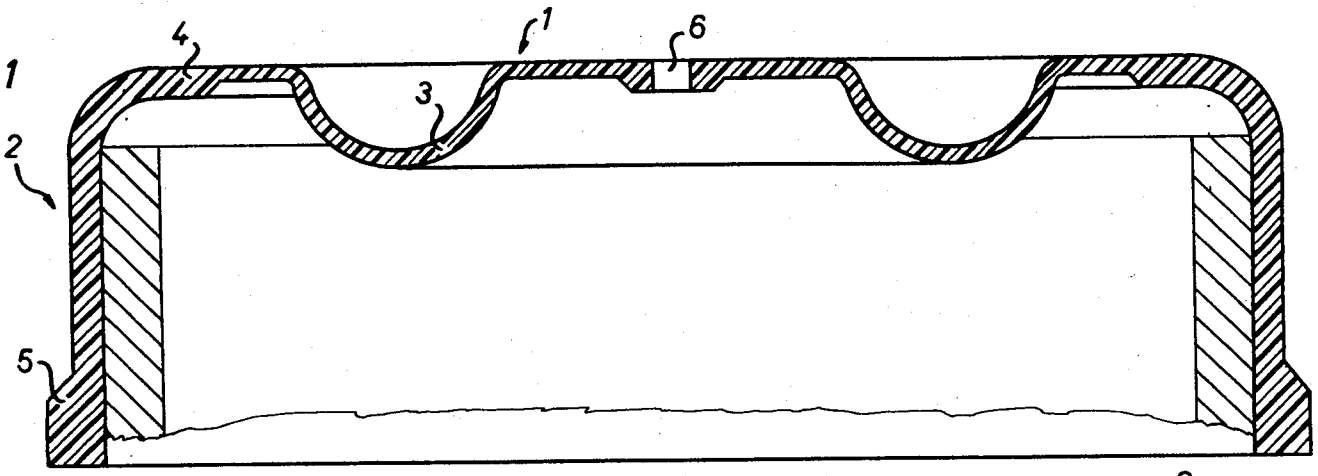
FIG. 1 is a side, sectional view of a protective cap in accordance with a preferred embodiment of the present invention.
Figure 3:
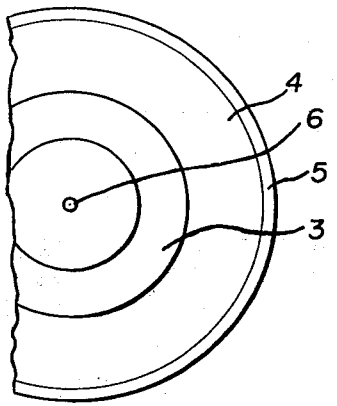
FIG. 3 is a partial plan view of the protective cap of FIG. 1.

The cap of FIGS. 1 and 3 includes a floor portion 1 and a wall portion 2. The floor 1 includes an expansion section 3 which forms a part of the floor 1 and is a centered, ring-shaped indentation with a semi-circular cross-section. The expansion section 3 permits radial expansion of the floor 1.

The wall 2 has a greater material thickness than does the floor 1. The greater material thickness extends to the outer perimeter region 4 of the floor 1, since the transition portion between the floor 1 and the wall 2 is an exposed, and therefore easily damaged part.

The wall 2 is bounded at its lip, or rim remote from the floor portion 1 by an outer retaining bead 5. The bead 5 provides a further strengthening of the cap, since it prevents a possible tearing of the cap in the process of fitting it over the end of the pipe section. The material thickness of the bead 5 is greater than that of the wall 2 and is preferably twice the thickness of the wall 2.

Figure 2:
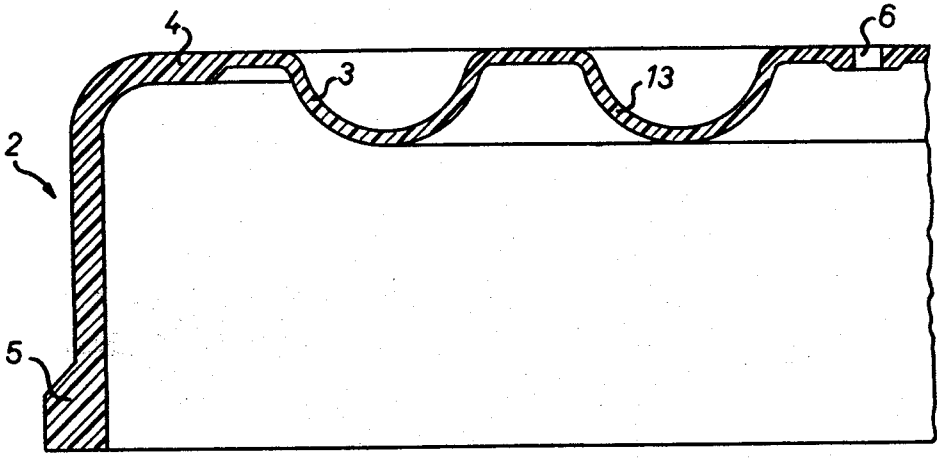
FIG. 2 is a side, sectional view of a fraction of a protective cap which is an alternative preferred embodiment of the present invention.

The described cap is made of an elastic material, preferably an ethylene-propylene elastomer. It is essential that the elastic material be resistant to weathering, particularly the effects of ozone and sunlight. The expansion section 3 in the floor 1 is essential for the described cap. While in the embodiment of FIG. 1 there is a single ring-shaped expansion section 3, in the embodiment of FIG. 2 the cap has both an outer expansion section 3 and an inner expansion section 13. In other respects the caps of FIGS. 1 and 2 are similar. That is, the embodiment of FIG. 2 likewise has a perimeter region of the floor 1 which is thicker than the remainder of the floor 1 and a bead 5 at the rim of the wall 2 which is thicker than the wall 2 by the same proportions as the bead 5 of the embodiment of FIG. 1 is thicker than the wall 2 of FIG. 1.

With regard to both the embodiments of FIGS. 1 and 2, the expansion sections 3, or 13 are essential for a reliable functioning of the cap. Even when there are relatively large tolerances for the end portions of the pipe sections, it is not necessary to use different models of the cap. Due to the provision of the expansion sections 3, 13 in the floor 1, a single cap size can suffice for the tolerance range of a particular size of pipe section. At the same time, the expansion sections 3, 13 assure that no, or only insignificant tension force acts on the wall 2, so that after mounting, the wall 2 is securely retained. By means of the relatively large bead 5, the retaining force of the cap on the end of the pipe section is increased. At the same time, transport damage, i.e. pressing into an oval or denting of the pipe, is prevented. The bead 5 also reduces the generation of noise, since the pipes can, as a practical matter, no longer knock together.

The expansion sections 3, 13 can also be designed in other ways. However, the ring-shaped configuration appears particularly suitable, since thereby any tensioning is uniformly reduced at the perimeter of the floor 1.

In the center of the floor 1 of the cap there is provided a small ventilation port 6. This provides an air exchange from outside into the inside of the pipe and the reverse, thereby preventing the generation of odors inside the pipe section. The ventilating port 6 is nevertheless sufficiently small that practically no foreign substance can find its way to the inside. It also assures a pressure equalization between the inside space of the pipe section and the outer atmosphere. This makes easier the installation of the cap and prevents undesired stress (negatively influencing the retention) from arising.

The outer surface of the cap can be further used for identifying the pipe section by, for example, giving the rated size and also the name of the manufacturer.

I claim:

1. In a protective cap which fits over an end of a section of pipe having a generally cylindrical wall portion and a floor portion fixed at and closing one end of said wall portion to define a cup shape therewith, the improvement comprising said wall portion having a greater thickness then said floor portion and a rim remote from said floor portion;

means for increasing the retaining force of said wall portion comprising an endless circumferential retaining bead at said rim; and expansion means formed in said floor portion for permitting radial expansion of said floor portion, said expansion means comprising an annular depression of generally semi-circular cross section, said depression being centrally located in said floor portion and concentric with said wall portion and extending from said floor portion in the same direction as said wall portion.

2. A protective cap according to claim 1, wherein said wall and floor portions comprise an ethylene-propylene elastomer.

3. A protective cap according to claim 1, wherein said floor portion has an increased thickness near its outer perimeter.

4. A protective cap according to claim 1, wherein said floor portion has a small ventilating port therein.

5. A protective cap according to claim 1, wherein said wall and floor portions comprise an elastomer.

* * * * *